United States Patent [19]

Hirayama

[11] Patent Number: 4,592,210

[45] Date of Patent: Jun. 3, 1986

[54] AIR CONDITIONER

[75] Inventor: Shoji Hirayama, Yamato, Japan

[73] Assignee: Hirayama Setsubi Kabushiki Kaisha, Kanagawa, Japan

[21] Appl. No.: 720,802

[22] Filed: Apr. 8, 1985

[51] Int. Cl.[4] ..... F25D 21/14

[52] U.S. Cl. ..... 62/288; 62/272

[58] Field of Search ..... 62/281, 272, 285, 288, 62/289, 290, 291

[56] References Cited

U.S. PATENT DOCUMENTS 2,001,309 5/1935 Kelly ..... 62/281

2,111,570 3/1938 Neeson ..... 62/281

*Primary Examiner*—Henry Bennett

*Attorney, Agent, or Firm*—Parkhurst & Oliff

[57] ABSTRACT

An air conditioner in which a drain pan disposed under a heat exchanger can completely collect and exhaust liquid such as condensed liquid or hot liquid and air intaken from an air intake port is passed through a ventilation passage, thereby completely air conditioning in the corners and the vicinity of a floor surface, the heat exchanger for preferably exchanging heat in a large capacity can be installed in a conditioner body and the size of the conditioner can be still constructed in small size. Thus, the air conditioner can completely condition the corners and the position near a floor surface in the room.

5 Claims, 7 Drawing Figures

AIR CONDITIONER

BACKGROUND OF THE INVENTION

This invention relates to an air conditioner for cooling, refrigerating or heating in a room and, more particularly, to improvements in an air conditioner adapted to completely condition the corners and the position near a floor surface in the room.

In a conventional air conditioner of this type, as shown in FIG. 7, a drain pan 30 is constructed to merely collect and exhaust liquid and is not considered for its air permeability. Thus, the air intake port 31 is typically formed at the lower side surface 33 of the air conditioner body 32. Therefore, air intake in the corners of a room and in the vicinity of a floor surface is insufficient, and satisfactory air conditioning in the corners and in the vicinity of the floor surface cannot be accomplished. Since the air intake port is thus located, the heat exchanger of the air conditioner is disposed to occupy a longitudinally extending space in the body, thereby increasing the size of the air conditioner body itself.

SUMMARY OF THE INVENTION

Accordingly it is an object of the present invention to provide an air conditioner in which a drain pan disposed under a heat exchanger can completely collect and exhaust liquid (such as condensed liquid or hot liquid) while air taken in from an air intake port is passed through a ventilation passage in the pan, thereby completely air conditioning the corners and the vicinity of the floor surface. A large capacity heat exchanger can be installed in an air conditioner body, while the size of the are conditioner can still be constructed in a small size.

The foregoing objects and other objects as well as the characteristic features of the invention will become more fully apparent and more readily understandable by the following description and the appended claims when read in conjunction with the accompanying drawings.

BRIEF DESCRIPTION OF THE DRAWINGS

FIGS. 3 and 4 are schematic views showing an example of a drain pan arranged in the conditioner body, wherein FIG. 3 is a longitudinal sectional view, and FIG. 4 is a side view;

DESCRIPTION OF THE PREFERRED EMBODIMENTS

An embodiment of an air conditioner constructed according to this invention will be described in more detail with reference to the accompanying drawings.

Figure 1:
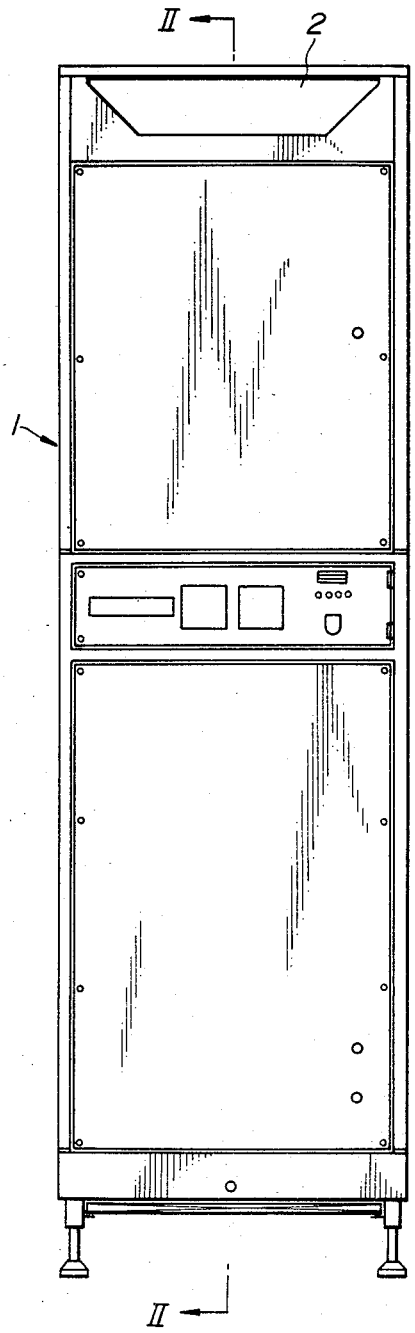
FIG. 1 is a front elevational view of an air conditioner constructed according to the present invention.
Figure 2:
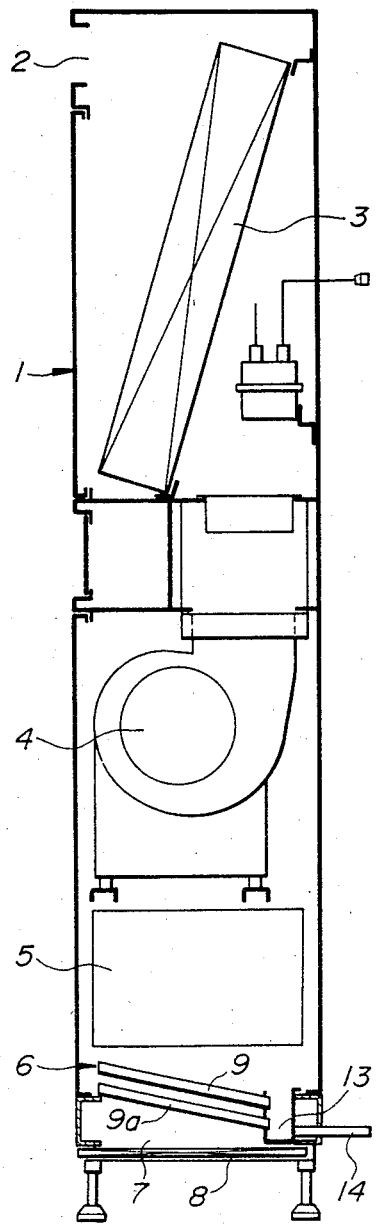
FIG. 2 is a sectional view, taken along the line II—II in FIG. 1.

As shown in FIGS. 1 and 2, an air conditioner body 1 is formed with an air diffuser 2 at the upper side portion, and a filter 3 for removing (bonding to) dust is disposed inside the upper portion of the body 1.

An air circulating blower 4 is provided under the filter 3, and a coil of a cooling, refrigerating or heating heat exchanger 5 is arranged under the blower 4. A drain pan 6 for collecting and exhausting liquid such as condensed liquid or hot liquid produced by the heat exchanger 5 is disposed uner the heat exchanger 5. An air intake port 7 for taking in air from the room into the body 1 is formed in the bottom of the body 1, i.e., under the pan 6, and a prefilter 8 for removing (adhering) dust is mounted in the intake port 7 in the same manner as the filter 3.

In the air conditioner of the structure described above, air in the room is taken into the body 1 by the blower 4 from the intake port 7 in the bottom of the body 1, thermally exchanged through the heat exchanger 5, and fed through the filter 3 from the air diffuser 2 into the room.

Figure 3:
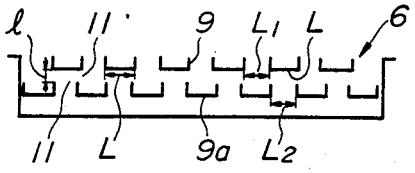
Figure 4:
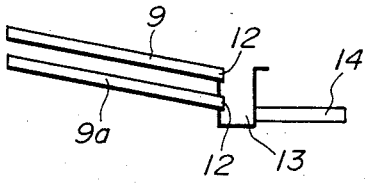

FIGS. 3 and 4 show an example of the drain pan 6. The pan 6 is constructed such that U-shaped through members are disposed in two stages spaced by a predetermined interval l and a plurality of upper stage trough members 9 and a plurality of upper stage trough members **9*a*** are respectively disposed at predetermined intervals $L_1$ and $L_2$ in a widthwise direction.

Further, the width L of the bottom of each upper stage member 9 is at least equal to or wider than the spacing interval $L_2$ of the lower stage **9*a*, and the bottoms of each upper stage member 9 are disposed on the upper extension line of the lower stage members 9*a* at the interval $L_2$. Furthermore, the upper and lower stage members 9 and 9*a* are spaced vertically by an interval l to allow passage of air from the room. The interval $L_2$ formed between adjacent lower stage members 9*a*, the interval l formed between the upper and lower stage members 9 and 9*a*, and the interval $L_1$ formed between adjacent lower stage members 9 generally form a ventilation passage 11** to allow passage of air from the room.

The upper and lower stage members 9 and **9*a* are integrally coupled through a supporting member at the end faces of their upper ends, and spaced to form openings 12 for draining liquid at their lower ends. The openings 12 are open into a drain passage 13 formed in the body 1, and a drain conduit 14 projecting externally from the body 1 is connected to the passage 13**.

In the structure of the pan described above, liquid produced from the heat exchanger 5 is completely collected by the upper and lower stage the members 9 and **9*a*, and the collected liquid is externally exhausted from the body 1 through the drain conduit 14 via the drain passage 13 by the trough members 9 and 9*a*. Further, the air taken in from the inlet port 7 at the lower end of the body 1 is fed through the passage 11 formed in the pan 6 toward the heat exchanger 5**.

The pan 6 of the structure described above operates to collect, exhaust the liquid and pass the air as described above, and simultaneously incorporates the members 9 and **9*a*** arranged as described above for sound shielding properties and sound absorbing properties, thereby providing sound shielding effects and sound absorbing properties to sufficintly silence the drive noise generated by the blower.

Figure 5:
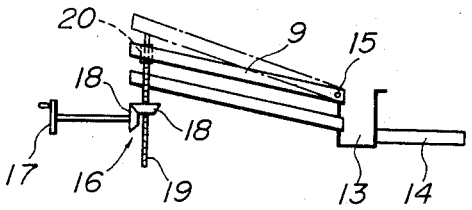
FIG. 5 is a side view of another example of a drain pan.

FIG. 5 shows another example of the pan. In this example, an upper stage trough member 9 of the pan 6 is pivotally secured.

More particularly, one side end with the opening 12 of the upper stage member 9 is pivotally secured via a shaft 15, and a drive mechanism 16 for elevationally operating the member 9 is mounted at the other (upper)

end. The drive mechanism 16 is composed of a rod 19 coupled through a gear 18 to the handle 17 for rotation upon operation of a handle 17, and a slide member 20 secured to the trough member side and engaging the rod 19. When the rod 19 is rotated, the slide member 20 slides up or down the rod 19, and the member 19 is thus pivoted about its lower end.

Thus, the upper stage trough member 9 is set pivotally, thereby allow regulation and alteration of the interval to the lower stage trough members 9*a*. Thus, the interval l to the lower stage members 9*a* can be regulated or altered, thereby regulating the amount of air passing through the pan 6. This is advantageous in that the flowrate of the air circulated in the body 1 can be adjusted by considering the degree of clogging of the filter 3 and the prefilter 8.

The above-described drive mechanism is not limited to each upper stage particular embodiment. For example, the member 9 also may have a mechanism capable of altering its angle.

Figure 6:
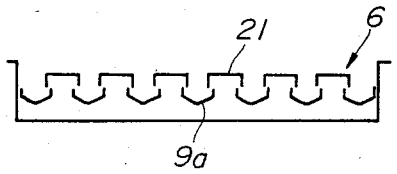
FIG 6 is a sectional view of still another example of a drain pan.
Figure 7:
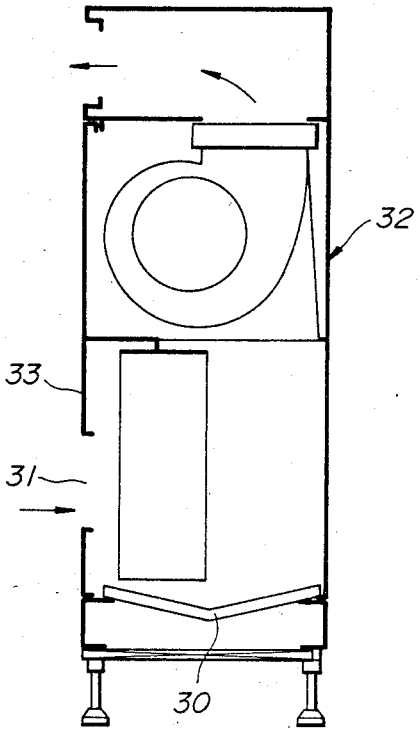
FIG. 7 is a view showing a conventional air conditioner.

FIG. 6 shows still another example of a drain pan. The pan 6 of this example is constructed such that the upper stage members 21 corresponding to the upper stage trough members 9 are formed in an inverted U sectional shape, while the lower stage members 9*a* are constructed in the same manner as the first example.

In this embodiment liquid such as condensed liquid or hot liquid is collected in the lower stage member 9*a*.

According to the invention as described above, the air conditioner of the invention has a drain pan capable of completely collecting and exhausting liquid (such as condensed water or hot water) under a heat exchanger provided in the conditioner body, said pan having a ventilation passage for passing the air taken in from the lower intake port in the body toward the heat exchanger, so as to completely condition the air in the corners and in the vicinity of the floor surface in the room, formed at the lower end of the body near the floor surface. Further, the drain pan is constructed to have a ventilation passage, thereby using it without waste in the space of the body, and accordingly mounted in the body. Consequently, heat exchange in the air conditioner can be preferably accomplished by installing a larger heat exchanger (having a large heat exchanging capacity) in the body and can be much reduced in size compared with the conventional air conditioner.

What is claimed is:

1. An air conditioner comprising:

an air conditioner body having a heat exchanger, a blower and a main filter disposed in flow series therein;

an air diffuser located in said air conditioner body on a side of said main filter opposite from said blower for diffusing air out of said body and into a room;

an air intake port disposed substantially in the bottom of said air conditioner body for taking air into said body from said room;

a drain pan disposed beneath said heat exchanger and above said air intake port for collecting liquid dripping from said heat exchanger, said drain pan comprising an upper and a lower plurality of substantially U-shaped trough members, wherein each lower trough member is substantially co-planar with the other lower trough members and is spaced from adjacent lower trough members by a first pre-determined interval, wherein each upper trough member is substantially co-planar with the other upper trough members and is spaced from adjacent upper trough members by a second pre-determined interval, wherein said upper and lower trough members are staggered such that each upper trough member overlaps a corresponding first pre-determined interval between two lower trough members and each lower trough member overlaps a corresponding second pre-determined interval between two upper trough members, and wherein said upper members are spaced vertically from said lower trough members, such that said spacings between said trough members collectively form an air passage through said drain pan;

a drain passage for conveying liquid collected by said drain pan out of said air conditioner body, said drain pan being obliquely mounted and having openings formed at the lower ends of said trough members opening into said drain passage such that liquids collected in said drain pan will drain by gravity into said drain passage; and a drive mechanism attached to upper ends of at least one of said upper and lower pluralities of trough members for driving said upper ends upwardly and downwardly, said at least one plurality of trough members being mounted pivotally at said lower ends thereof.

2. An air conditioner according to claim 1, wherein said drive mechanism comprises:

a rotatably mounted operational handle;

a rotatably mounted rod rotatably driven by said handle; and a slide member secured to said upper ends of said at least one plurality of pivotally mounted trough members and drivingly engaged with said rod, said slide member being moved upwardly or downwardly upon rotation of said rod.

3. An air conditioner according to claim 1, wherein said upper U-shaped trough members open downwardly, and said lower U-shaped trough members open upwardly.

4. An air conditioner according to claim 1, wherein said upper and lower U-shaped trough members all open upwardly.

5. The air conditioner of claim 1, wherein a base of each upper trough member is slightly wider than said first predetermined interval.

* * * * *